US011502437B2

(12) United States Patent
Brand

(10) Patent No.: US 11,502,437 B2
(45) Date of Patent: Nov. 15, 2022

(54) ELECTRICAL CONTACT ELEMENT FOR ELECTRICAL CONTACTING WITH A COUNTERPART CONTACT ELEMENT

(71) Applicant: Phoenix Contact GmbH & Co. KG, Blomberg (DE)

(72) Inventor: Fredrik Brand, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 17/281,285

(22) PCT Filed: Oct. 10, 2019

(86) PCT No.: PCT/EP2019/077493
§ 371 (c)(1),
(2) Date: Mar. 30, 2021

(87) PCT Pub. No.: WO2020/078824
PCT Pub. Date: Apr. 23, 2020

(65) Prior Publication Data

US 2021/0399456 A1 Dec. 23, 2021

(30) Foreign Application Priority Data

Oct. 18, 2018 (DE) ..... 10 2018 125 843.7

(51) Int. Cl.
*H01R 13/18* (2006.01)
*H01R 13/11* (2006.01)

(52) U.S. Cl.
CPC ..... *H01R 13/18* (2013.01); *H01R 13/111* (2013.01)

(58) Field of Classification Search
CPC ..... H01R 13/18
See application file for complete search history.

(56) References Cited

U.S. PATENT DOCUMENTS 4,728,304 A 3/1988 Fischer
5,167,543 A * 12/1992 Wurster ..... H01R 13/111 439/856
6,589,084 B1 * 7/2003 Frank ..... H01R 13/111 439/620.26
9,293,852 B2 * 3/2016 Glick ..... H01R 13/18
(Continued)

FOREIGN PATENT DOCUMENTS

DE 102007042194 A1 3/2009
DE 102013001836 B3 3/2014
(Continued)

*Primary Examiner* — Ross N Gushi
(74) *Attorney, Agent, or Firm* — Leydig, Voit & Mayer, Ltd.

(57) ABSTRACT

An electrical contact element for electrically contacting a mating contact element includes: a plurality of contact lamellae which are arranged around a plug opening into which a mating contact element is pluggable along a plug direction and which together form a groove that encircles the contact lamellae around the plug direction; and a spring element that is arranged on the groove and engages the contact lamellae to provide an elastic clamping force on the contact lamellae. The contact lamellae each have an inner surface which faces the plug opening and is straight in cross section transversely to the plug direction.

21 Claims, 7 Drawing Sheets

(56) References Cited

U.S. PATENT DOCUMENTS

| | | | | |
|---|---|---|---|---|
| 9,325,095 | B2 * | 4/2016 | Glick ..... | H01R 13/187 |
| 2013/0017739 | A1 | 1/2013 | Glick et al. | |
| 2017/0302017 | A1 | 10/2017 | Inoue | |

FOREIGN PATENT DOCUMENTS

| | | | |
|---|---|---|---|
| DE | 202016106663 | U1 | 3/2018 |
| EP | 1339145 | A1 | 8/2003 |
| EP | 2833385 | B1 | 5/2017 |
| EP | 3206263 | A1 | 8/2017 |
| FR | 1234270 | A | 10/1960 |
| GB | 218324 | A | 2/1925 |
| JP | H 01187716 | A | 7/1989 |
| JP | 2009176901 | A | 8/2009 |

* cited by examiner (A-A)

(B-B)

(C-C)

(D-D)

(E-E)

ELECTRICAL CONTACT ELEMENT FOR ELECTRICAL CONTACTING WITH A COUNTERPART CONTACT ELEMENT

CROSS-REFERENCE TO PRIOR APPLICATIONS

This application is a U.S. National Phase application under 35 U.S.C. § 371 of International Application No. PCT/EP2019/077493, filed on Oct. 10, 2019, and claims benefit to German Patent Application No. DE 10 2018 125 843.7, filed on Oct. 18, 2018. The International Application was published in German on Apr. 23, 2020 as WO 2020/078824 under PCT Article 21(2).

FIELD

The invention relates to an electrical contact element for electrically connecting to a mating contact element.

BACKGROUND

Such a contact element comprises a plurality of contact lamellae which are arranged around a plug opening into which a mating contact element can be plugged in along a plug direction and which form a groove that encircles the contact lamellae around the plug direction. A spring element is arranged at the groove and engages around the contact lamellae in order to provide an elastic clamping force on the contact lamellae.

In such a contact element, which forms a contact socket with its plug opening, electrical contacting is effected via the contact lamellae. To establish an electrical contact, a mating contact element with a contact pin can be inserted into the plug opening, so that the contact pin can be electrically contacted with the contact lamellae and an electrical current can be transmitted.

In order to provide sufficient contact force at the contact lamellae, which is maintained over the service life of the electrical contact element, a spring element is arranged on the contact lamellae, said spring element also being referred to as an overspring and surrounding the contact lamellae on the outside such that the contact lamellae are elastically prestressed radially inward.

The spring element serves as a mechanical element (exclusively) for providing the elastic contact force and may consist, for example, of a material which does not relax under the influence of heat, which can ensure that the contact force is maintained over the service life of the contact element.

A conventional spring element bent from a stamped sheet metal part is comparatively expensive to produce. There is thus a need for a contact element having a spring element which can be produced simply and cost-effectively while nevertheless providing an elastic prestressing force.

In a contact element known from GB 218324 A, a spring element is arranged on contact lamellae and is formed by a spring wire wound around the contact lamellae.

A contact element is known from FR 1234270 A, in which a spring element formed from a stamped sheet metal part encompasses contact lamellae.

In a contact element known from DE 10 2013 001 836 B3, an overspring is formed by a stamped sheet metal part.

Contact elements of the type in question can be manufactured, for example, as stamped bent parts from a metal sheet. In this case, the contact elements are stamped from sheet metal as solid parts and brought into their desired, in particular cylindrical form by round bending.

Conventionally, in round bending, a body member from which the contact lamellae are extended is bent, and in addition, the contact lamellae are brought into a rounded shape, so that the contact lamellae which are arranged in sequence together form a (approximately) cylindrical plug opening.

When such a contact element is produced by stamping and bending, burrs may possibly occur at the contact lamellae as a result of the stamping. If such burrs are not removed, burrs on the contact lamellae can come into contact with the mating contact element when the contact element is connected to an associated mating contact element and thereby contribute to wear. Such wear should be avoided if possible.

In addition, it is desirable to securely hold the spring element in engagement with the groove in a form-fitting manner on the contact lamellae in such a way that the spring element cannot be easily removed from the contact lamellae, at least not inadvertently.

DE 20 2016 106 663 U1, DE 10 2007 042 194 A1, JP 2008-013153 A and EP 2 833 385 B1 disclose contact elements which have rounded contact lamellae for the joint formation of a plug opening.

SUMMARY

In an embodiment, the present invention provides an electrical contact element for electrically contacting a mating contact element, comprising: a plurality of contact lamellae which are arranged around a plug opening into which a mating contact element is pluggable along a plug direction and which together form a groove that encircles the contact lamellae around the plug direction; and a spring element that is arranged on the groove and engages the contact lamellae to provide an elastic clamping force on the contact lamellae, wherein the contact lamellae each have an inner surface which faces the plug opening and is straight in cross section transversely to the plug direction.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 9 a side view of the arrangement as per FIG. 3, with the mating contact element plugged in;

DETAILED DESCRIPTION

Figure 1:
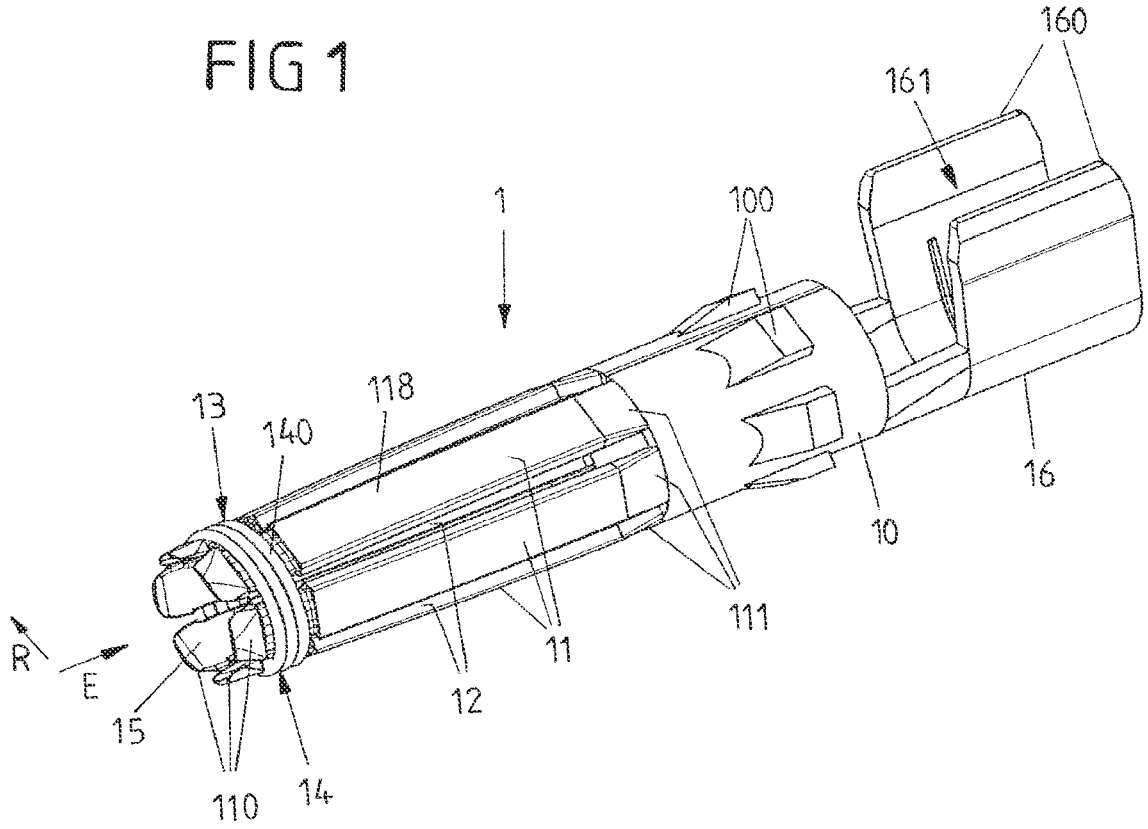
FIG. 1 a perspective view of an exemplary embodiment of a contact element.
Figure 2:
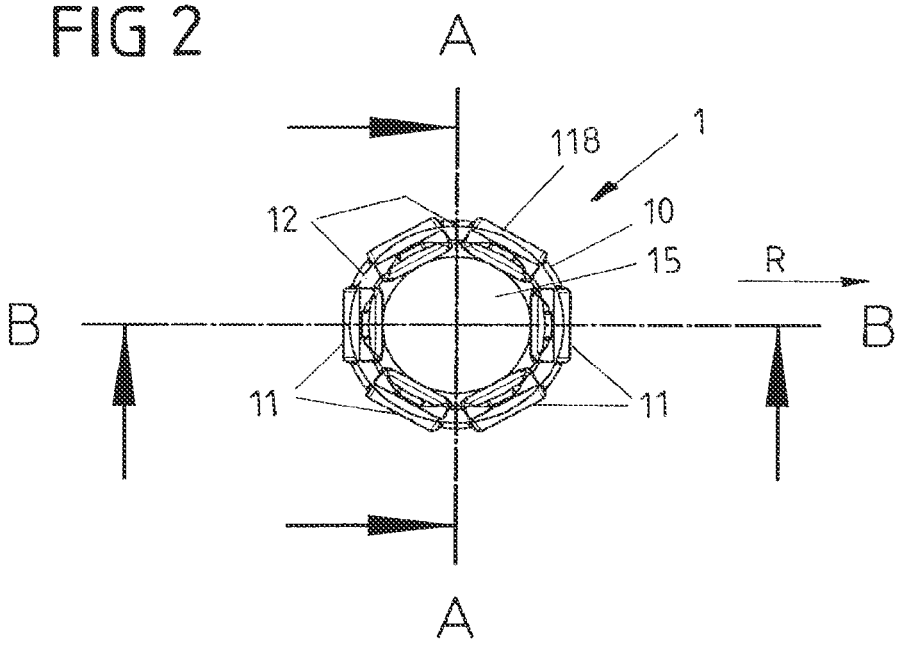
FIG. 2 a front view of the contact element.

In an embodiment, the present invention provides a contact element for connecting, in a plug-in manner, to an associated mating contact element which is simple to produce and exhibits an advantageous operating behavior during operation, also particularly in view of wear during connecting, in a plug-in manner, to an associated mating contact element.

Accordingly, the contact lamellae each have an inner surface which faces toward the plug opening and which is straight in cross section transversely to the plug direction.

The contact lamellae are thus not curved at their inner surfaces facing the plug opening, but rather are straight. The contact lamellae thus extend flat and are grouped around the plug opening in such a way that they jointly form the plug opening.

The fact that the contact lamellae are flat in the region of their inner surfaces results, for one, in a simple production. The contact element can be manufactured, for example, as a stamped bent part by the contact element being rolled up from a punched surface element. The contact element is thus produced by punching from a solid, flat sheet metal element and by bending it round (in the sense of rolling up) so that a contact element with a substantially cylindrical basic shape results. The contact element thus rolled up by round bending is joined in sections at a joint line extending along the plug direction to a part extending circumferentially around the plug direction and thus at least partially closed circumferentially.

The fact that the contact lamellae are flat simplifies production because the individual contact lamellae do not have to be rounded. The round bending can thus be limited, for example, to a body element from which the contact lamellae are extended and on which the contact lamellae are arranged in an in sequence aligned form.

As a result of the contact lamellae being flat (at least in sections in the region of the inner surface), lateral edges of the contact lamellae are spaced apart from the mating contact element (for example in the form of a cylindrical contact pin) in a position in which the contact element is connected to a mating contact element. Even if burrs arise at the lateral edges of the contact lamellae during punching and, as appropriate, are not completely removed during production, the risk of wear during connecting, in a plug-in manner, of the contact element to an associated mating contact element is at least reduced because such burrs cannot come into direct contact with the associated mating contact element.

Thirdly, the form of the contact lamellae enables a defined contact of the contact lamellae with the associated mating contact element, in that the contact lamellae come into contact with the associated mating contact element in a defined contact region during the plug connection. Thus, even with existing tolerances, a defined electrical contact with sufficient contact force is produced. This enables a favorable performance during operation with low contact resistance, for example for transmitting high currents.

The flat form of the contact lamellae also makes it possible to apply a coating to the contact lamellae before forming, rather than before round bending. Since the contact lamellae are not bent during forming, the risk of the coating being damaged, in particular spalling, at the contact lamellae is low.

The groove on the contact lamellae is formed, for example, by stamping. In this case, a groove section is stamped into each contact lamella in such a way that the groove sections on the contact lamellae are in sequence with one another when the contact element is bent and jointly form the groove. The shaping of the groove by stamping makes it possible to limit the groove in the axial direction by sharp edges directed approximately perpendicular to the plug direction. As the contact lamellae are flat, the groove can also be deeper in the region of the lateral edges of the contact lamellae, so that the spring element is held in the groove in a form-fitting, secure manner and cannot easily disengage from the groove. The risk of the spring element being accidentally stripped from the contact element during operation is thus at least reduced.

Each contact lamella is preferably rounded in cross section transversely to the plug direction in the region of the groove and forms a support section on which the spring element rests. The fact that the shape of the support section is adapted by rounding the extent of the spring element around the contact lamella results in a depression in the groove, in particular at the lateral edges of the contact lamellae, with comparatively sharp axial limiting edges which ensure a secure seating of the spring element in the groove.

The support section, viewed axially along the plug direction, is limited on each contact lamella, preferably on both sides, by an edge formed in the respective lamella. Such edges are created during stamping and are preferably extended approximately perpendicular to the plug direction, so that a sharp-edged boundary is created for the groove and thus for the retention of the spring element on the groove.

When viewed in cross section transversely to the plug direction, the contact segment of each contact lamella can follow a circular contour in such a way that a circular, circumferential groove results on the contact lamellae which are in sequence with one another and in which the spring element can be accommodated.

However, in order to exert a defined spring force on each contact lamella, it may be advantageous to round the support section on each contact plate in such a way that a defined, reduced effective area for the spring element to act on the respective contact lamella results and accordingly the spring element on the contact lamella provides a defined spring force which is introduced in a predetermined manner and is as tolerance-independent as possible. For this purpose, the support section, viewed in cross section transversely to the plug direction, can have a central region adjoined on respective sides by a secondary area. In this case, the curvature at the support section can have a radius of curvature that is smaller than the radius of curvature of the spring element (viewed in cross section transversely to the plug direction) so that the spring element only rests against the respective contact lamella in the central region of the support section, but not in the adjoining side regions. The spring force is thus introduced into the contact lamella via the central region, so that a defined spring force is provided at each contact lamella and is introduced into the respective contact lamella in a defined manner.

In one embodiment, the contact element has more than two, preferably more than four contact lamellae, for example six contact lamellae or eight contact lamellae, which are in sequence with one another along a circular line extending around the plug direction to form the plug opening. The contact element thus has a substantially cylindrical basic shape, in which the plug opening is embodied approximately cylindrically and is formed by the contact lamellae which are in sequence with one another along a circular line. The contact lamellae jointly form the plug opening and surround the plug opening in such a way that when an associated mating contact element is plugged in, each contact lamella comes into electrically contacting contact with the mating contact element.

The contact element preferably has a body element, from which the contact lamellae are extended along the plug direction. The body element and the contact lamellae can, for example, be formed in one piece and consist of an electrically conductive (metal) material.

The spring element is preferably arranged at ends of the contact lamellae which rest remote from the body element. The contact lamellae are separated from one another, for example, by slots extending longitudinally along the plug direction and can be radially expanded when connected to a mating contact element.

Due to the fact that the spring element is arranged at the ends of the contact lamellae which are remote from the body element, the spring element provides a favorable contact force for electrical contacting with a contact pin inserted into the plug opening at these remote ends.

The body element can preferably be rounded when the contact element is produced. The body element can thus have a cylindrical shape. During the production of the contact element, the contact element is, for example, initially stamped from a flat sheet metal element and then curved, so that a cylindrical shape is established on the body element. However, the contact lamellae are not bent in each case (viewed in cross section transversely to the plug direction) but extend in a flat manner along the plug-in direction from the body element.

In one embodiment, the contact lamellae each have a curved contour on the inside in the region of their ends remote from the body element, viewed along a cross-sectional plane spanned by the plug direction and a radial direction directed radially to the plug direction. The contour can have a convex basic shape at the ends of the contact lamellae in such a way that an associated mating contact element can be brought into engagement with the plug opening and in contact with the contact lamellae surrounding the plug opening in a simple, easily insertable manner.

In particular, the contour can form a convexly curved contact section for abutment against a mating contact element inserted into the plug opening. In the region of the contact section, each contact lamella is thus convexly curved, viewed in the cross-sectional plane spanned by the plug direction and the radial direction, so that a defined point position of each contact lamella is produced on the associated mating contact element when the mating contact element is inserted into the plug opening of the contact element.

A first convexly curved contour section and a second convexly curved contour section are in turn provided on the contact section and on the first convexly curved contour section. In this case, the first convexly curved contour section and the second convexly curved contour section are arranged on a side of the contact section remote from the body element and form an insertion contour which permits easy insertion of an associated mating contact element into the plug opening via the ends of the contact lamellae protruding from the body element.

For example, the first convexly curved contour section may have a first radius of curvature, while the second convexly curved contour section has a second radius of curvature. Due to the fact that the second radius of curvature is smaller than the first radius of curvature, a curvature is produced at the ends of the contact lamellae which are remote from the body element and thus form the entrance of the plug opening for the mating contact element so that the mating contact element can easily be inserted into the plug opening of the contact element, with (slight) radial expansion of the contact lamellae relative to one another.

For example, the contact section and the adjoining first convexly curved contour section may have the same radius of curvature.

In one embodiment, a concavely curved contour section may be provided on the contact section on a side facing the body element. This concavely curved contour section may extend axially from the contact section to the body member when viewed along a cross-sectional plane spanned by the plug direction and the radial direction. Each contact lamella is thus curved inwardly in an arc-shaped manner starting from the body element, which has the effect that the plug opening is slightly narrowed at the ends of the contact lamellae protruding from the body element and is thus widened when the mating contact element is plugged in. The electrical contact is thereby provided in particular at the ends of the contact lamellae which are remote from the body element and on which the spring element also acts to provide an elastic clamping force.

In one embodiment, the contact lamellae each have a bevel inclined obliquely to the plug direction at their ends facing away from the body element in the region of an end facing away from the inner surface. Such a bevel allows the spring element to be simply pushed onto the contact lamellae for engagement in the groove. Such a bevel can thus simplify the mounting of the contact element, in particular for attaching the spring element.

In this case, the bevel may extend from the end remote from the body element to an edge delimiting the groove and formed in the respective contact lamella. The bevel thus forms an leading bevel by means of which the spring element can be pushed onto the respective contact lamella in such a way that the spring element surrounds the contact lamellae in the mounted position and lies in the groove formed on the contact lamellae.

Alternatively, the spring element can also be wound around the contact lamellae by winding a spring wire and thus be produced directly on the contact lamellae.

The spring element can be formed, for example, by a spring wire which extends around the contact lamellae. In this case, the spring wire can preferably have a (circular) round, an oval or also a polygonal (for example a rectangular) cross section. A spring wire is generally characterized by a relatively long length compared to the cross-sectional size. The spring wire can, for example, be made of spring steel (so-called spring steel wire).

If the spring element is formed by a coiled spring wire, a particularly simple, cost-effective production results, which can be automated in a favorable manner.

The use of a spring element, which is formed by a coiled spring wire, offers the further advantage that spring elements of the same type can be used for contact elements of different dimensions given the same production. In this way, the spring element can be scaled with the diameter of the contact element without the production of the spring element changing fundamentally—by winding the spring wire beforehand or directly at the contact lamellae. Spring elements of the same type can thus be used on contact elements of different dimensions.

If the spring body of the spring element is formed by a spring wire, it is advantageous to select the number of turns in such a way that, on the one hand, a sufficient contact force is provided on the contact lamellae and is uniformly distributed over the circumference of the plug opening, and, on the other hand, it is possible to plug the mating contact element into the plug opening in a reliable and simple manner while expanding the spring element. In simulations and experiments, it has been found that it can be advantageous if the spring element has more than one turn, for example between 1.5 and 3 turns, preferably between 1.8 and 2.2 turns, for example 1.9 turns. On the one hand, a circumferentially uniform contact force can be achieved in this region. On the other hand, the circumferential length of the spring body is not excessively large, so that self-locking is avoided during expansion (which could otherwise be the case if the wire length is too long due to the frictional contact on the outside of the contact lamellae).

In principle, a spring wire of the same thickness can be used with differently dimensioned contact elements, i.e. with different socket geometries. However, it can also be possible to use a spring wire of the same diameter with the larger socket geometries and a spring wire of smaller diameter in the case of smaller socket geometries.

For example, the contact element can be a component of a plug connector part which is designed, for example, as a charging plug or as a charging socket of a charging device for charging an electric vehicle. However, the contact element can also be a component of a plug connector part of a solar module or another electrical device in order to connect electrical lines to one another in an electrically contacting manner.

FIGS. 1 to 14 show an exemplary embodiment of a contact element 1 which may, for example, be a component of a plug connector part 2 in the form of a charging plug of a charging device for charging an electric vehicle or in the form of a plug for a solar module.

The contact element 1 of the exemplary embodiment in FIGS. 1 to 14 is configured as a contact socket and has a plurality of contact lamellae 11 (six in the exemplary embodiment shown) which are grouped around a plug opening 15 and thereby define the plug opening 15. The contact lamellae 11 extend axially along a plug direction E from a body element 10, are connected at ends 111 to the body element 10, and are arranged with the ends 110 remote from the body element 10. The contact lamellae 11 are produced in one piece with the body element 10 from an electrically conductive material, in particular a metal material.

In order to produce an electrical contacting, a mating contact element 2 (see FIG. 5) can be inserted in the plug direction E into the plug opening 15 between the contact lamellae 11. The mating contact element 2, which has a contact pin, thereby comes into contact with the contact lamellae 11 on the inside, so that a current can flow between the mating contact element 2 and the contact element 1.

The contact lamellae 11 extend from the body element 10 along the plug direction E and are separated from each other by slits 12. A slit 12 is arranged between each two adjacent contact lamellae 11 so that adjacent contact lamellae 11 are cut free from one another by the slit 12 extending between them. When the mating contact element 2 is plugged in, the contact lamellae 11 are widened (slightly), in particular at their ends 110 that are remote from the body element 10 so that the contact lamellae 11 bear against the mating contact element 2 with mechanical pretensioning and thus a contact force for producing an electrical contact of low resistance acts between the contact lamellae 11 and the mating contact element 2.

In order to improve the contact force, in particular in order to ensure a sufficient contact force over the service life of the contact element 1, a spring element 14 (also called an overspring) encompasses the contact lamellae 11 at their outer sides 118 so that the spring element 14 causes a radially inwardly pointing pretensioning force on the contact lamellae 11 in the region of the ends 110. The spring element 14 lies in a groove 13 provided in the region of the ends 110 of the contact lamellae 11 and circumferentially running on the outer side 118 of the contact, and is thereby fixed axially to the contact lamellae 11.

Figure 3:
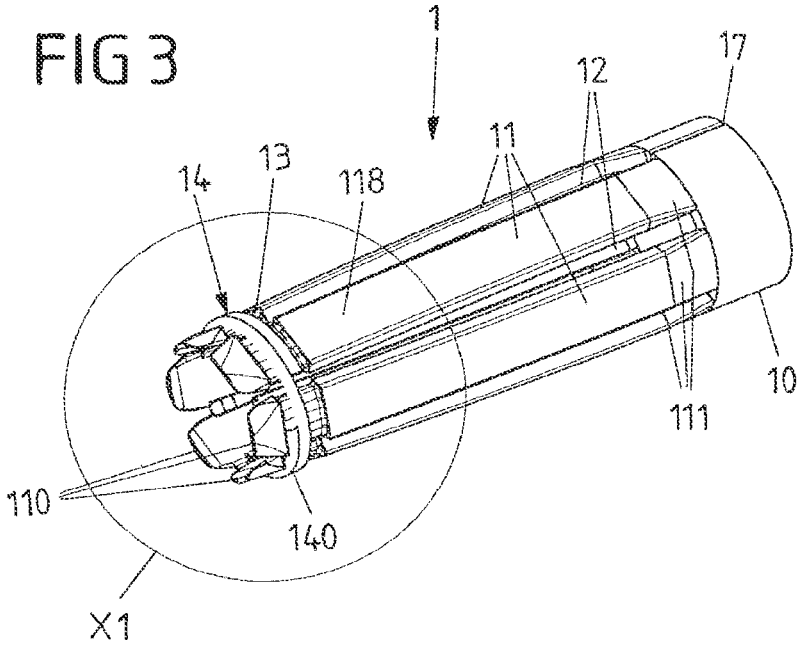
FIG. 3 a perspective view of the contact element illustrating a body element and contact lamellae extended from the body element.
Figure 4:
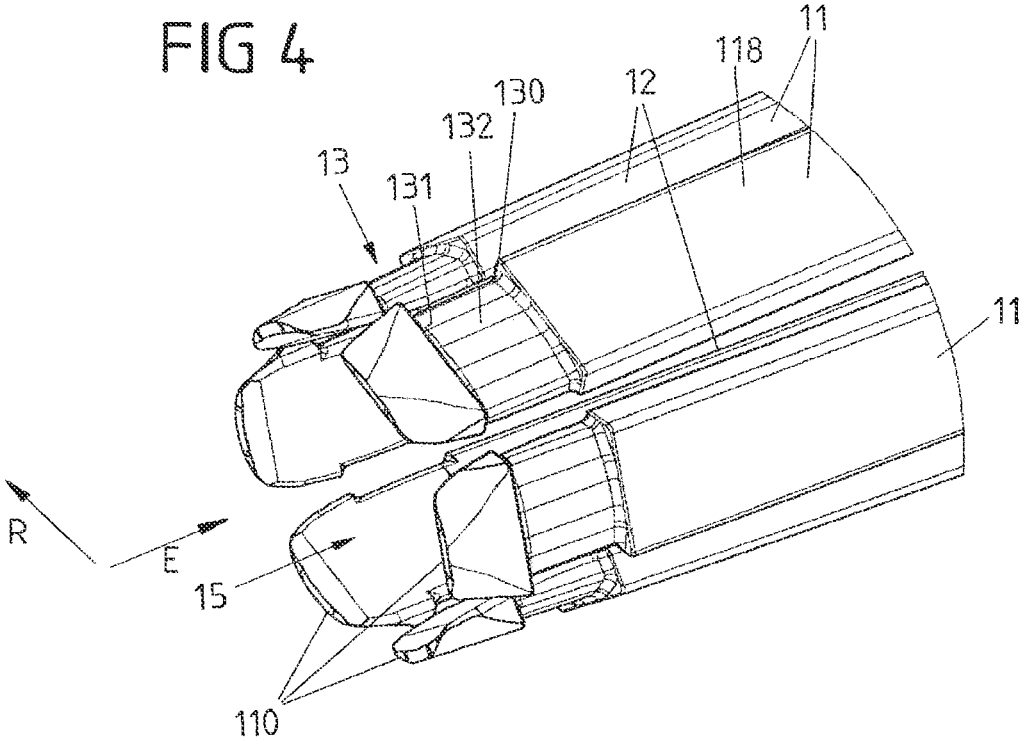
FIG. 4 an enlarged sectional view in the pane X1 as per FIG. 3.
Figure 6:
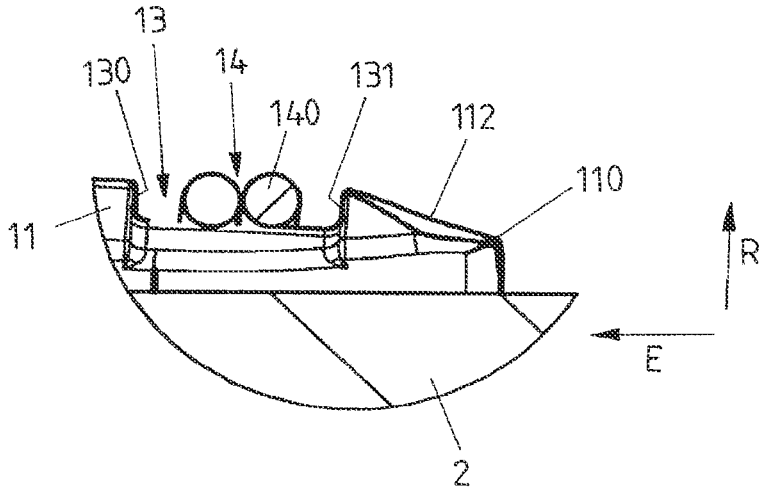
FIG. 6 an enlarged sectional view in the pane X2 as per FIG. 5.

As can be seen, for example, from FIGS. 3 and 6 the spring element 14 is formed by a spring wire 140 which is formed by a coiled spring wire arranged on the contact lamellae 11. The spring element 14 formed in this way has the shape of a helical tension spring and has a comparatively small pitch, so that adjacent turns of the spring element 14 touch one another.

When the contact element 1 is connected in a plug-in manner to an associated mating contact element 2, the contact lamellae 11 are pressed radially inward, causing the spring element 14 to expand. After removal of the mating contact element 2, the contact lamellae 11 are also returned to their initial position under the effect of the biasing force of the spring element 14.

When designing the spring element 14, it must be taken into account—especially when selecting the number of turns—that the spring element 14 should, on the one hand, provide an at least approximately uniform contact force over the circumference and, on the other hand, that the insertion process should be possible in a smooth manner. Tests and simulations have shown that an optimum can lie in a range between 1.5 and 3 turns, in particular in a range between 1.8 and 2.2 turns, for example 1.9 turns. As a general rule, it may not be possible to achieve a uniform contact force over the circumference if too few turns are used. On the other hand, if too many windings are used, self-locking can occur on the outside of the contact lamellae 11 when plugged in with an associated mating contact element due to the frictional contact, which can make plugging extremely difficult or even impossible.

In the contact element 1, the contact lamellae 11 are extended from the body element 10. The body element 10 has a cylindrical, cross-sectionally circular shape (see FIG. 14) whereas the contact lamellae 11 are each flat and are each flat in cross section (see FIG. 13). The contact lamellae 11 in this case each have an inner surface 117 facing the plug-in opening 15 and, when connected in a plug-in manner to an associated mating contact element 2, come into contact with the mating contact element 2 via the inner surfaces 117.

The contact element 1 can, for example, be designed as a stamped and bent part. During production, the contact element 1 is stamped from a sheet metal element, which is initially flat, and then shaped by round bending (also referred to as "rolling") so that an approximately cylindrical shape results on the body element 10, as can be seen in FIGS. 1 and 3. For this purpose, during round bending, a surface section forming the body element 10 is formed in such a way that the surface section is bent along a joint line 17 to form the circumferentially closed cylindrical body element 10.

During reshaping, a connection section 16 is also provided on a side of the body element 10 facing away from the contact lamellae 11 which has lateral legs 160 and a gap 161 formed between the legs 160 and thus enables an electrical conductor core to be inserted and crimped for connecting to the contact element 1.

As can be seen in FIG. 1, fastening elements 100 can be formed on the body element 10 in the form of latching lugs projecting radially inward, by means of which fixing of the contact element 1 to, for example, a contact carrier of a connector part is possible.

By virtue of the fact that the body element 10 is round-shaped during round bending, but the contact lamellae 11 remain flat, production is simplified. In particular, the contact lamellae 11 need not be individually rounded.

By virtue of the fact that the contact lamellae 11 have a flat shape in cross section transversely to the plug direction E, the wear behavior of the contact element 1 can also be improved. In particular, burrs at the lateral edges of the contact lamellae 11 extending along the slots 12 cannot easily lead to wear, because the lateral edges of the contact lamellae 11 are radially spaced apart from the cylindrical contact pin of the mating contact element 2 when the mating contact element 2 is inserted and thus there is no direct contact between the lateral edges of the contact lamellae 11 and the mating contact element 2.

The fact that the contact lamellae 11 are of flat design also results in a defined contact when the mating contact element 2 is inserted. Accordingly, the contact lamellae 11, in cross section transversely to the plug direction E, contact the mating contact elements 2 at a defined contact point when the mating contact element 2 is inserted into the plug opening 15 which ensures, in particular, that a sufficient contact force can be provided at the transition between the contact lamellae 11 and the mating contact element 2 with a defined contact.

In cross-section along a cross-sectional plane spanned by the plug-in direction E and a radial direction R, each single contact lamella 11 is curved on the inner surface 117 to a contour defined by different contour sections 113-116. Hereby, contact is made at each contact lamella 11 via a contact section 115 which is convexly curved in the cross-sectional plane spanned by the plug-in direction E and the radial direction R, as can be seen in particular in FIGS. 7 and 8. The convex curvature of the contact section 115 has the result that a defined, approximately point-shaped abutment of each contact lamella 11 with the mating contact element 2 also occurs in the axial direction, so that there is a defined abutment with a defined contact force caused inter alia by the spring element 14.

Figure 7:
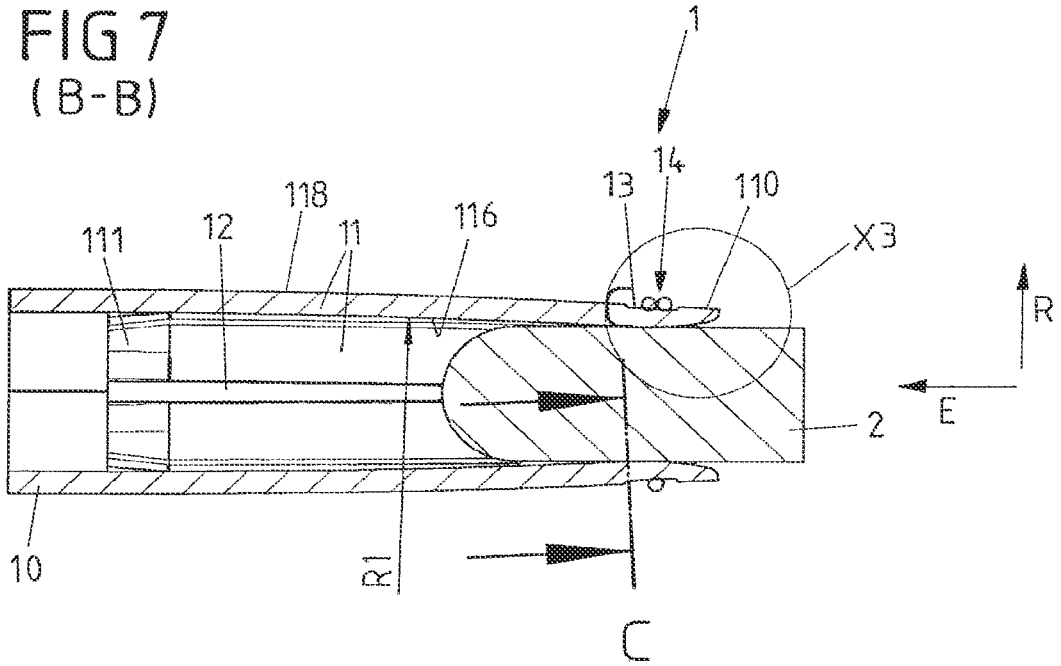
FIG. 7 a sectional view along the line B-B as per FIG. 2.
Figure 8:
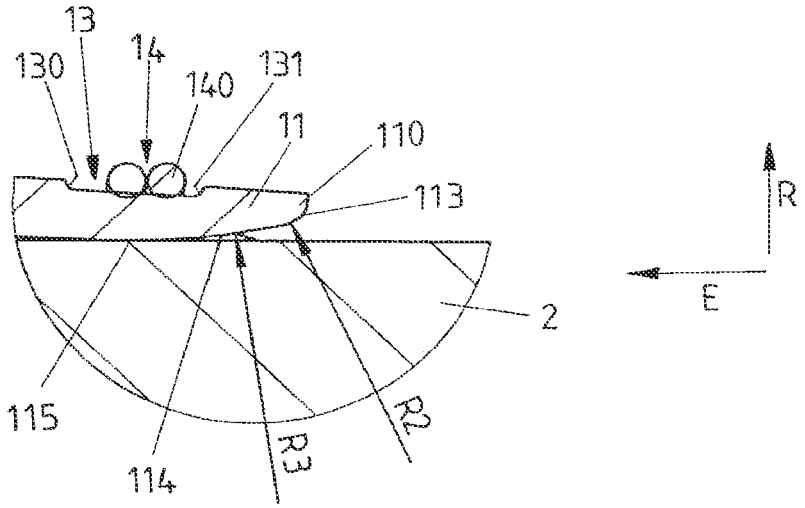
FIG. 8 an enlarged sectional view in pane X3 as per FIG. 7.

As can be seen in FIGS. 7 and 8 the convexly curved contact section 115 is formed in such an axial region of each contact lamella 11 in which the groove 13 is also formed on the inside of the contact lamellae 11 so that the spring element 14 effects an elastic clamping force precisely in the region of the contact section 115 of each contact lamella 11.

On a side remote from the body element 10, contour sections 113, 114 which are convexly curved but have different radii of curvature R2, R3 follow the contact section 115 of each contact lamella 11. Thus, the contact section 115 and the contour section 114 directly adjacent to the contact portion 115 have a (same) first radius of curvature R3 that is (significantly) larger than the radius of curvature R2 of the adjacent contour section 113. Together, the contour sections 114, 113 thus form an inlet geometry which brings about a widening of the plug opening 15 towards the end of the plug opening 15 remote from the body element 10 and thus enables a simple, smooth insertion of a mating contact element 2 in the plug direction E.

On a side facing the body element 10, a concavely curved contour section 116 is applied to the contact section 115 of each contact lamella 11, as can be seen in FIG. 7. Each contact lamella 11 is thus curved (slightly) inwards starting from the body element 10, which causes the contact lamellae 11 to come into contact with an inserted mating contact element 2 essentially at their ends 110 remote from the body element 10 and thus enabling a defined contact of the contact lamellae 11 under a defined contact force.

The spring element 14 is located in the groove 13 formed on the inside of the contact lamellae 11. The groove 13 is formed jointly by groove sections on the contact lamellae 11, the groove 13 being delimited in the axial direction of each contact lamella 11 along the plug direction E by edges 130, 131 as can be seen in FIGS. 5 and 6.

The groove sections are formed, for example, by stamping on the individual contact lamellae 11. During stampling, sharp edges 130, 131 are formed on the individual contact lamellae 11 which extend approximately perpendicular to the plug direction E so that the spring element 14 can be securely accommodated between the edges 130, 131 and held on the contact lamellae 11 in the mounted position.

Figure 5:
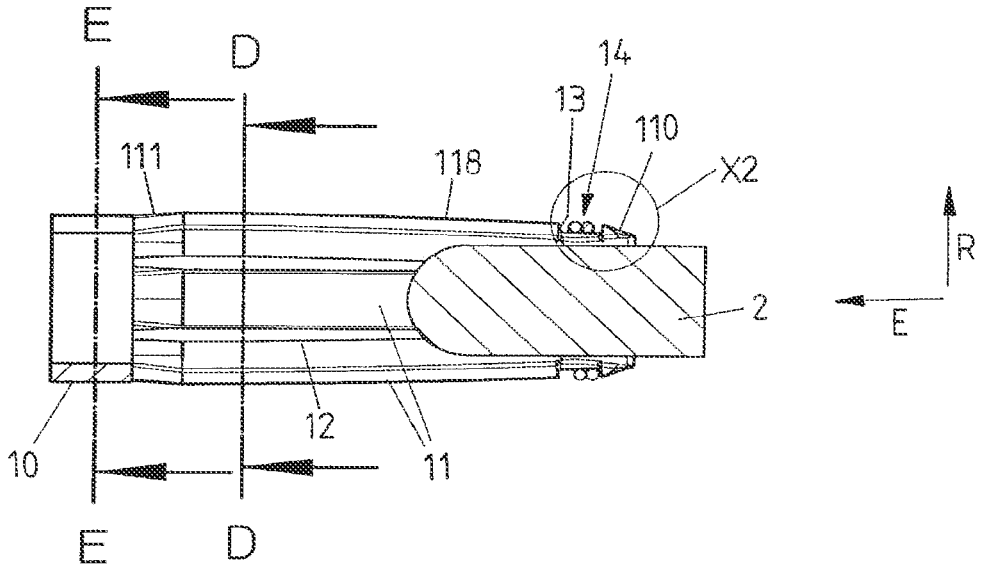
FIG. 5 a sectional view along the line A-A as per FIG. 2.
Figure 11:
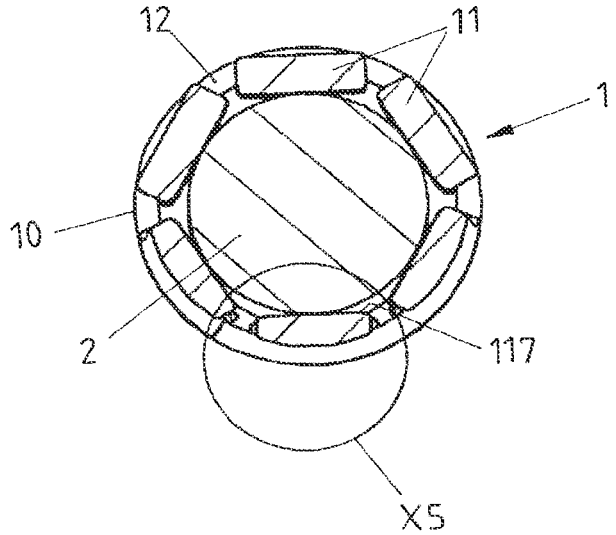
FIG. 11 a sectional view along the line C-C as per FIG. 7.
Figure 12:
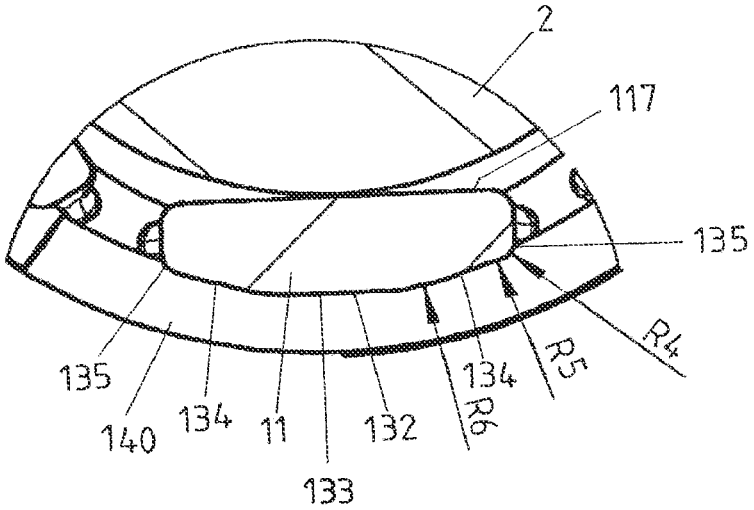
FIG. 12 an enlarged sectional view in the pane X5 as per FIG. 11.
Figure 13:
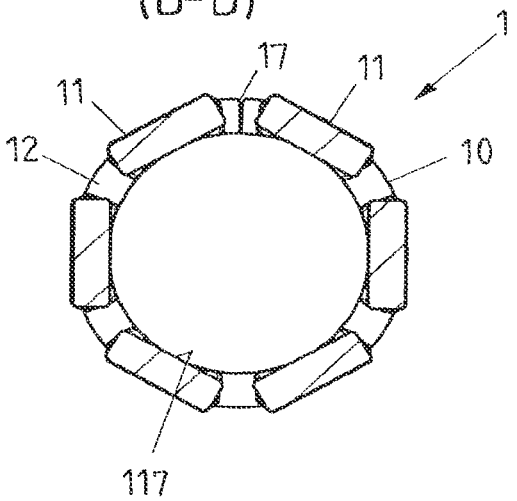
FIG. 13 a sectional view along the line D-D as per FIG. 5.
Figure 14:
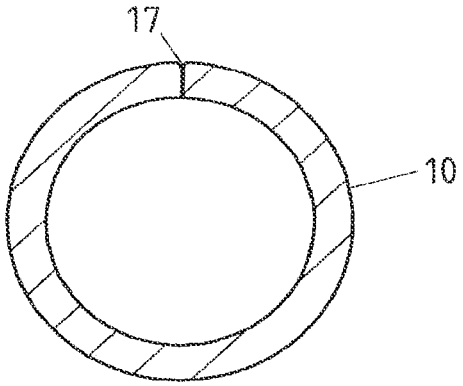
FIG. 14 a sectional view along the line E-E as per FIG. 5.

As can be seen from the cross-sectional views shown in FIGS. 11 and 12 in conjunction with FIGS. 5 and 6, a support section 132 is formed in the region of the groove 13 on each contact lamella 11 and provides a support for the spring element 14 on the contact lamella 11. In this case, the support section 132 is curved in a cross-sectional plane transversely to the plug direction E, which in particular has the effect that the groove 13 is deeper at the lateral edges of the contact lamellae 11 and thus the spring element 14 is securely held in the groove 13 on the contact lamellae 11 (see in particular also FIGS. 3 and 4).

The supporting portion 132 of each contact lamella 11 has a curvature which is larger than the curvature of the spring element 14. Thus, the support section 132 forms a central region 133 on both sides of which secondary regions 134 are provided. The central region 133 may have a radius of curvature R6 which is smaller than the radius of curvature of the spring element 14. In addition, the adjoining secondary regions 134 each have a radius of curvature R5 which is (significantly) smaller than the radius of curvature of the spring element 14 and optionally also smaller than the radius of curvature R6 of the central region 133. This has the effect that the spring element 14 rests substantially in the central region 133 on the support section 132 and thus acts on the respective contact lamella 11 essentially centrally (viewed in the cross-sectional plane transversely to the plug direction E as per FIGS. 11 and 12).

The secondary regions 134 are each delimited by edge regions 135 that have a curvature with a small radius of curvature R4. The radius of curvature R4 is significantly smaller than the radii of curvature R5, R6 in the areas 133, 134. Over the edge regions 135, the support section 132 is rounded at its lateral, exterior edges, so that sharp-edged transitions are avoided.

Figure 9:
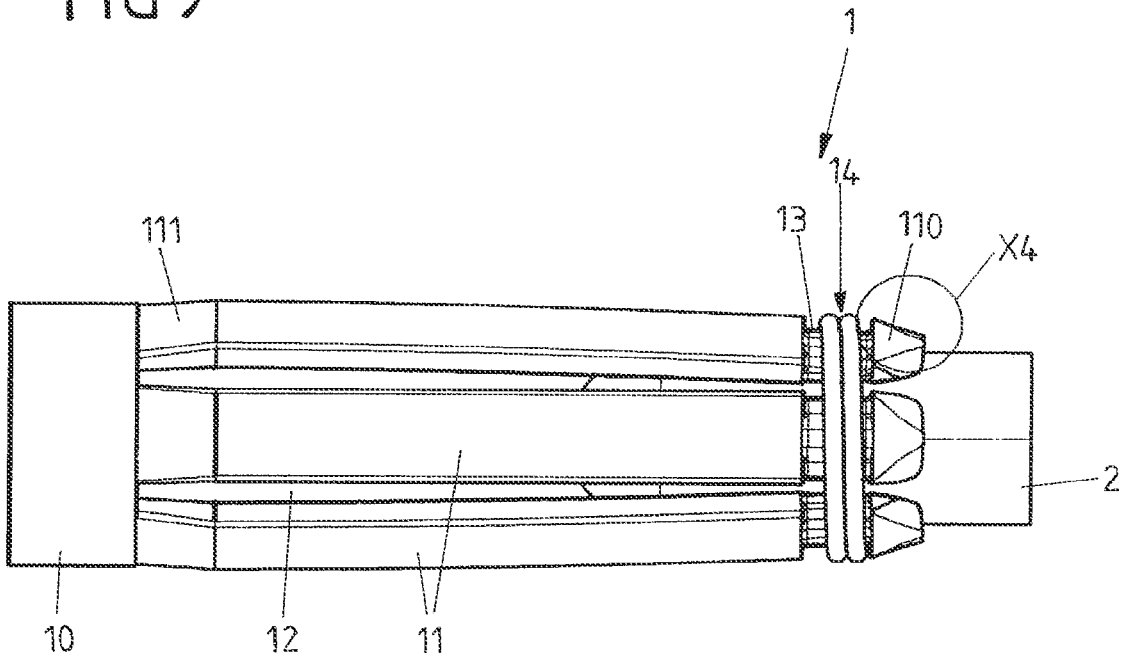
Figure 10:
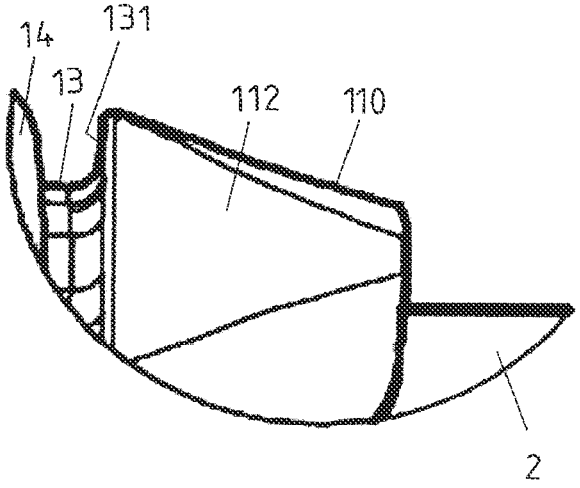
FIG. 10 an enlarged sectional view in the pane X4 as per FIG. 9.

As can be seen in FIGS. 9 and 10, each contact lamella 11 has a bevel 112 in the exemplary embodiment, which allows the spring element 14 to be easily pushed along the plug direction E over the ends 110 of the contact lamellae 11. When pushed on, the spring element 14 runs onto the bevels 112 on the contact lamellae 11 and is thereby expanded (slightly) radially until the spring element 14 engages the groove 13 and thus rests between the edges 130, 131 delimiting the groove.

The bevel 112 at end 110 of each contact plate 11 extends to the edge 131 of the groove 13 which is remote from the body element 10 and thus provides a guide for the spring element 14 up to the groove 13. The contact lamellae 11 are also laterally beveled at their ends 110 in the region of the outer side 118 in order to form two lateral radii which are set obliquely to the circumferential direction, as shown in FIGS. 9 and 10, so that the flat shape of the contact lamellae 11 and in particular radially protruding lateral edges of the contact lamellae 11 do not hinder the sliding of the spring element 14 in plug direction E onto the contact lamellae 11.

In principle, the same contact lamellae shapes and the same type of spring elements 14 can be used for contact elements 1 of completely different dimensions, whereby the spring elements 14 can use a spring wire of the same diameter or a spring wire that is scaled depending on the socket geometry. Generally, in the case of a spring element 14 formed by a spring wire, the attachment of the spring element 14 to the contact element 11 can be automated in a simple manner, so that attachment of the spring element 14 by hand can be avoided and similar spring elements 14 can be used for different socking geometries.

The idea underlying the invention is not limited to the exemplary embodiments described above but can in principle be realized in a completely different manner.

A contact element of the type described therein can be used in particular in the case of a charging plug or a charging socket for a charging device for charging an electric vehicle. However, this is in no way limiting. Such a contact element can also be a component of a plug connector, for example of a solar module or another electrical device.

The number of contact lamellae can vary, also depending on the socking geometry. Smaller socket geometries can use fewer contact lamellae than the larger socket geometries.

The contact lamellae can be circumferentially arranged in sequence to create a substantially cylindrical plug opening. However, this is also not limiting. In principle, other geometries can also be created by contact lamellae, for example cross-sectionally square or rectangular plug openings.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 Contact element
10 Body element
100 Fastening element
11 Contact lamella
110, 111 End
112 Bevel
113-116 Contour section
117 Inner surface
118 Outer side
12 Slit
13 Groove
130, 131 Edge
132 Support section
133 Central region
134 Secondary region
135 Edge area
14 Spring element
140 Spring wire
15 Plug opening
16 Connecting section
160 Leg
161 Gap
17 Joint line
2 Mating contact element
E Plug direction
R Radial direction
R1-R6 Radius

The invention claimed is:

1. An electrical contact element for electrically contacting a mating contact element, comprising:

a plurality of contact lamellae which are arranged around a plug opening into which a mating contact element is pluggable along a plug direction and which together form a groove that encircles the contact lamellae around the plug direction; and a spring element that is arranged on the groove and engages the contact lamellae to provide an elastic clamping force on the contact lamellae, wherein the contact lamellae each have an inner surface which faces the plug opening and is straight in cross section transversely to the plug direction, and wherein the groove is formed by stamping into the contact lamellae, the groove being delimited in an axial direction by edges on the contact lamellae, the edges extending approximately perpendicular to the plug direction.

2. The contact element of claim 1, wherein the contact element comprises a stamped bent part.

3. The contact element of claim 1, wherein the contact element is rolled up from a punched planar element and is joined at a joint line extending along the plug direction to a part extending circumferentially around the plug direction.

4. The contact element of claim 1, wherein each contact lamella has, in a region of the groove, a support section that is rounded in cross section transversely to the plug direction.

5. The contact element of claim 1, wherein the electrical contact element has more than two contact lamellae which are in sequence with one another along a circular line extending around the plug direction to form the plug opening.

6. The contact element of claim 1, further comprising:

a body element from which the contact lamellae are extended along the plug direction.

7. The contact element of claim 6, wherein the spring element is arranged in a region of ends of the contact lamellae which are remote from the body element.

8. The contact element of claim 6, wherein the body element is round in cross section transversely to the plug direction.

9. The contact element of claim 6, wherein the contact lamellae each have a curved contour on the inner surface in a region of their ends that are remote from the body element, viewed along a cross-sectional plane spanned by the plug direction and a radial direction directed radially to the plug direction.

10. The contact element of claim 9, wherein the curved contour forms a convexly curved contact section configured to bear against a mating contact element inserted into the plug opening.

11. The contact element of claim 10, wherein a first convexly curved contour portion adjoins the contact portion, on a side facing away from the body element, and a second convexly curved contour portion adjoins the first convexly curved contour portion.

12. The contact element of claim 11, wherein the first convexly curved contour portion has a first radius of curvature and the second convexly curved contour portion has a second radius of curvature, and wherein the second radius of curvature is smaller than the first radius of curvature.

13. The contact element of claim 10, further comprising:

a concavely curved contour section that adjoins the contact section on a side facing the body element.

14. The contact element of claim 6, wherein the contact lamellae each have at a respective end thereof that is remote from the body element, in a region of an outer side facing away from the inner surface, a bevel inclined obliquely to the plug direction.

15. The contact element of claim 1, wherein the spring element comprises a spring wire which is wound around the contact lamellae.

16. The contact element of claim 15, wherein the spring element forms more than one turn.

17. An electrical contact element for electrically contacting a mating contact element, comprising:

a plurality of contact lamellae which are arranged around a plug opening into which a mating contact element is pluggable along a plug direction and which together form a groove that encircles the contact lamellae around the plug direction; and a spring element that is arranged on the groove and engages the contact lamellae to provide an elastic clamping force on the contact lamellae, wherein the contact lamellae each have an inner surface which faces the plug opening and is straight in cross section transversely to the plug direction, and wherein each contact lamella has, in a region of the groove, a support section that is rounded in cross section transversely to the plug direction.

18. The contact element of claim 17, wherein the support section, viewed axially along the plug direction, is limited on each contact lamella on both sides by an edge formed in the respective contact lamella.

19. The contact element of claim 17, wherein the support section, viewed in cross section transversely to the plug direction, has a central region and secondary regions which are in contact with the central region on both sides, and wherein the spring element rests against the respective contact lamella only in the central region of the support section.

20. An electrical contact element for electrically contacting a mating contact element, comprising:

a plurality of contact lamellae which are arranged around a plug opening into which a mating contact element is pluggable along a plug direction and which together form a groove that encircles the contact lamellae around the plug direction;

a spring element that is arranged on the groove and engages the contact lamellae to provide an elastic clamping force on the contact lamellae; and a body element from which the contact lamellae are extended along the plug direction, wherein the contact lamellae each have an inner surface which faces the plug opening and is straight in cross section transversely to the plug direction, and wherein the contact lamellae each have at a respective end thereof that is remote from the body element, in a region of an outer side facing away from the inner surface, a bevel inclined obliquely to the plug direction.

21. The contact element of claim 20, wherein the bevel of each contact lamella extends from the respective end thereof that remote from the body element to an edge which delimits the groove and is formed in the respective contact lamella.

* * * * *